United States Patent [19]

Strickland

[11] 4,022,138

[45] May 10, 1977

[54] DRAPERY PLEATING GUIDE FOR SEWING MACHINES

[76] Inventor: Robert V. Strickland, 9021 Wedd, Overland Park, 66212

[22] Filed: Oct. 10, 1975

[21] Appl. No.: 621,380

[52] U.S. Cl. ..... 112/146

[51] Int. Cl.[2] ..... D05B 35/08

[58] Field of Search ..... 112/146, 137, 121.15, 112/260, 257, 136, 75, 121.11; 223/35, 38; 33/174 R, 147 F

[56] References Cited

UNITED STATES PATENTS

| | | | |
|---|---|---|---|
| 947,605 | 1/1910 | Tillie | 112/75 |
| 2,209,371 | 7/1940 | Zablocki | 112/121.15 |
| 2,223,626 | 12/1940 | Ladue | 112/121.15 |
| 3,400,674 | 9/1968 | McClintock | 112/121.15 |
| 3,430,591 | 3/1969 | Kendall | 112/146 |
| 3,654,882 | 4/1972 | Kamena | 112/121.11 |
| 3,845,565 | 11/1974 | Newswanger | 33/174 R |

*Primary Examiner*—Werner H. Schroeder
*Assistant Examiner*—Peter Nerbun
*Attorney, Agent, or Firm*—John A. Hamilton

[57] ABSTRACT

A drapery pleating guide for sewing machines consisting of a base plate adapted to be supported by and moved over the bed plate of a sewing machine in a direction parallel to the stitch line, and slotted to permit stitching therethrough, a pair of guide fingers carried by the base plate parallel to the stitch line and at respectively opposite sides of the stitch line, and mechanism whereby one guide finger may be accurately spaced from the stitch line at a distance equal to one-half the fabric width to be used in each pleat, and the other guide finger spaced oppositely from the stitch line at a distance equal to one-half the pleat width plus the fabric width between pleats.

10 Claims, 10 Drawing Figures

Figure 1:
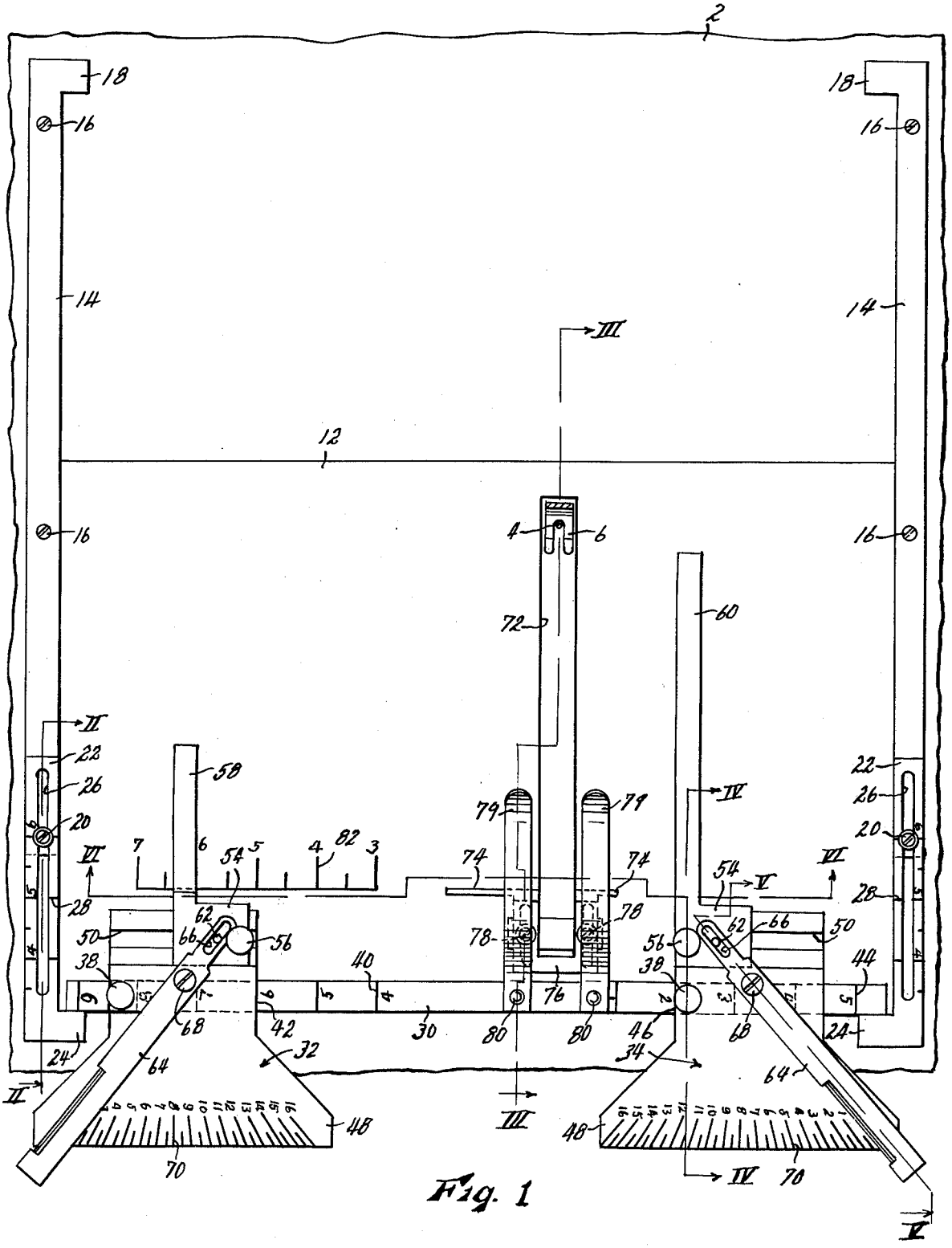

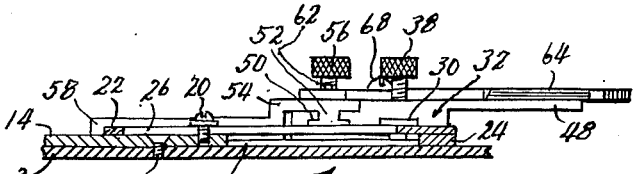
Fig. 2
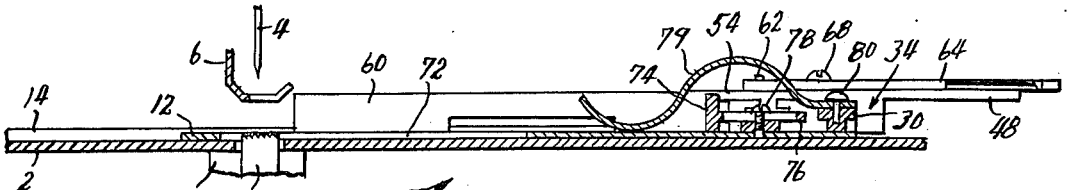
Fig. 3
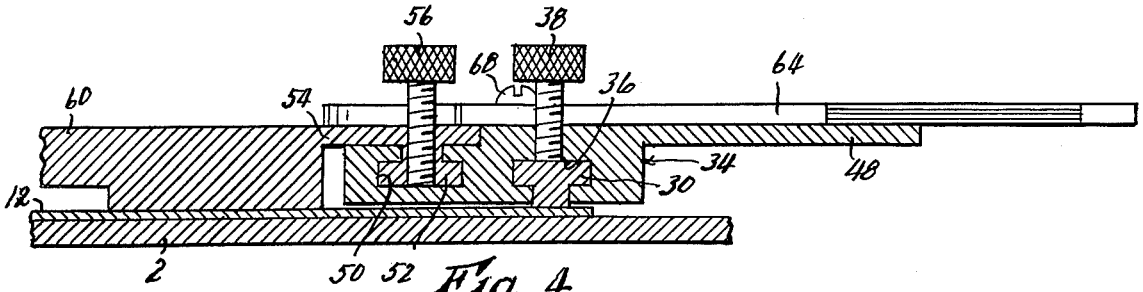
Fig. 4
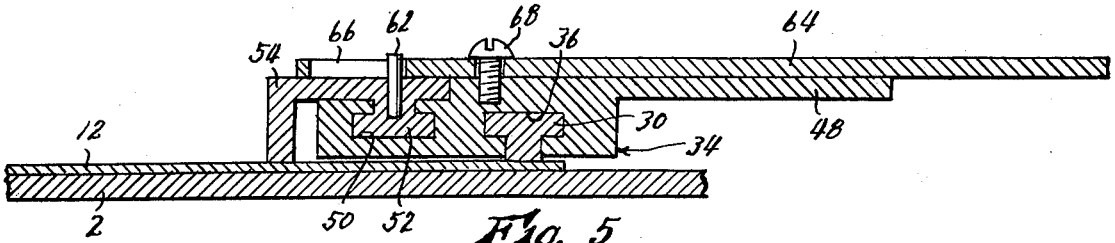
Fig. 5
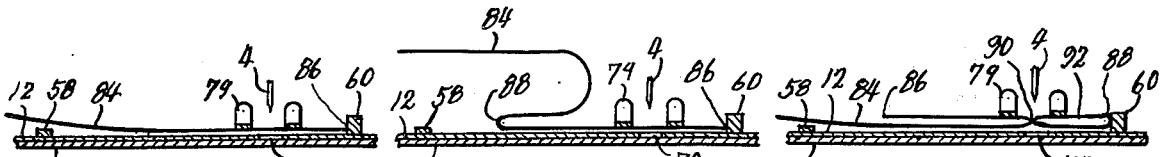
Fig. 6
Fig. 7
Fig. 8
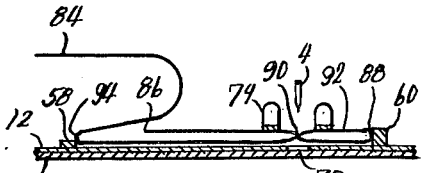
Fig. 9
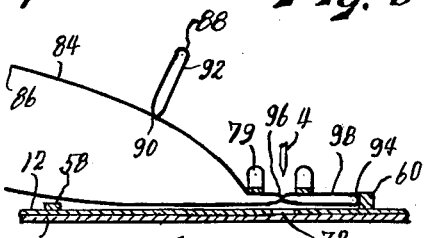
Fig. 10

DRAPERY PLEATING GUIDE FOR SEWING MACHINES

This invention relates to new and useful improvements in sewing machine attachments, and has as its principal object the provision of a pleating guide whereby draperies for windows and the like may be pleated accurately, speedily and conveniently.

A drapery panel is usually pleated by folding it outwardly along a vertical line at its upper edge portion, and stitching the layers together along a vertical line in spaced relation from the fold to form the pleat. Such pleats are formed at regular intervals across the face of the drapery panel, leaving the extreme end portions of the top edge of the panel unpleated, at one end to provide a portion of the panel width to be led around the end of the traverse rod, usually several inches from the wall line, to extend to the wall line, commonly called the "return", and at the other end to provide an overlap with the adjoining panel as is customary, most windows being provided with two panels which overlap each other at their contiguous edges when the drapes are closed. Thus the width of each panel consists of a "face" portion constituting most of its width, a return section at one edge, and an "overlap" portion at its opposite edge.

For attractive appearance, it is of course desirable that the endmost pleats be disposed accurately at the extreme side edges of the drapery face, and that the pleats be uniformly spaced and of equal depth. The proper sizing and placement of the pleats has heretofore constituted a rather tedious and laborious process involving much "back-of-the-envelope" computation, and inevitably a certain amount of trial and error. The computations must not only allow for the returns and overlaps, which are variable in different installations, but must also take into consideration such factors as the original width of the drapery panel face, the width to which it is desired to reduce the panel by the pleating, and the number and depth of pleats desired. The object of the present invention is the provision of a gauge or guide device which provides accurate measurement of returns and overlaps, and also for accurate sizing and spacing of the pleats, to the end that pleating may be started at one edge of the panel and continued across the full width of the panel with no resetting of the guide, and with accuracy well within the limits prescribed by the most exacting and fastidious of viewers.

Generally, this object is accomplished by the provision of a pleating guide consisting of a base plate movable over the bed plate of a sewing machine in a direction parallel to the stitch line of the machine, said base plate being adapted to support a portion of the drapery fabric, and being slotted to permit stitching of the fabric therethrough, and a pair of guide fingers carried by the base plate in parallel relation to the stitch line and movable relative to the base plate to vary the spacing thereof from the stitch line. One of these guide fingers, denoted the "Pleat Guide", is spaced at one side of the stitch line at a distance therefrom equal to one-half of the fabric width to be used in each pleat, and the other guide finger, denoted the "Spacer Guide", is positioned at the opposite side of the stitch line at a distance equal to the spacing of the pleat guide plus the desired spacing between pleats. Provision is made for making these settings with a high degree of accuracy, and the device is used in connection with a carefully computed and prepared set of charts and tables, giving the required settings of the guide fingers for drapery panels of different original widths, pleated widths, numbers of pleats and depth of pleats, allowing for variable returns and overlaps. The base plate includes a scale for measuring returns and overlaps.

Other objects are simplicity and economy of construction, efficiency and dependability of operation, and adaptability for use in pleating operations, other than in connection with draperies.

With these objects in view, as well as other objects which will appear in the course of the specification, reference will be had to the accompanying drawing wherein:

FIG. 1 is a top plan view of a drapery pleating guide for sewing machines embodying the present invention, shown in operative relationship to a sewing machine, FIG. 2 is a fragmentary sectional view taken on line II—II of FIG. 1, FIG. 3 is a fragmentary sectional view taken on line III—III of FIG. 1, FIG. 4 is an enlarged fragmentary sectional view taken on line IV—IV of FIG. 1, FIG. 5 is an enlarged fragmentary sectional view taken on line V—V of FIG. 1, and FIGS. 6-10 inclusive are reduced diagrammatic fragmentary sectional views, taken generally on line VI—VI of FIG. 1, successively showing progressive steps in the formation of pleats by the use of the guide.

Like reference numerals apply to similar parts throughout the several views, and the numeral 2 applies to the bed plate of an ordinary sewing machine, the upper surface of said bed plate being horizontal and planar. The needle 4 of the sewing machine, and its cooperating presser foot 6, are carried by a machine head, not shown, fixedly related to the bed plate, and are operable, in conjunction with a bobbin mechanism 8 and a feeder mechanism 10 disposed within and beneath an opening of the bed plate (see FIG. 3), to stitch together overlying layers of cloth moved over the bed plate in a horizontal direction. The stitch line, as it appears in FIG. 1, is a vertical line intersecting needle 4. This stitching action is common to most sewing machines, and is well understood in the sewing machine art.

The pleating guide forming the subject matter of the present invention includes a base plate 12 which is thin and planar and is positioned to lie flat and freely slidably on the top surface of the bed plate. Said base plate is rectangular, and slides on bed plate 2 in a direction parallel to the stitch line, being guided between a pair of straight guide rails 14 affixed to bed plate 2 in parallel relation, as by screws 16, so as to engage the side edges of the base plate. At its forward end, each rail 14 is provided with an inturned stop 18 which limits the forward movement of the base plate. At its rearward end, each rail 14 has affixed thereto, as by a clamp screw 20, a longitudinally extending arm 22 which extends rearwardly of the rail, and carries at its rearward end an inturned stop 24 which limits the rearward movement of base plate 12. Screw 20 extends through a longitudinally elongated slot 26 of arm 22, so that by loosening said screw, said arm may be moved forwardly or rearwardly so as to adjust the position of its stop 24. Imprinted on each arm 22, so as to be read in conjunction with screw 20, is a scale 28, calibrated in inches, in order that the total sliding movement of base plate 12, as permitted by stops 18 and 24, may be accurately adjusted. As will appear, the distance base plate 12 moves determines the length of the stitch line.

Extending along the rearward edge of base plate 12, and affixed to the upper surface thereof by any suitable means, not shown, is a carrier bar 30. Said carrier bar is of dove-tail cross-sectional contour, being wider at its top surface than at its lower surface. Mounted slidably on said carrier bar are a pair of carriage blocks 32 and 34, each of said carriage blocks having a dove-tail groove 36 formed in its lower surface which is in closely mating engagement with bar 30 so that it may be moved slidably along said bar, and may be clamped at any desired position on said bar by means of a set screw 38 threaded in said block. Block 32 is disposed toward the left end of bar 30, as viewed in FIG. 1, and its position on said bar may be determined by an inch scale 40 imprinted on said bar, and read in connection with edge 42 of said block. Block 34 is disposed toward the right end of bar 30, as viewed in FIG. 1, and its position on said bar may be determined by an inch scale 44 imprinted on said bar, and read in connection with edge 46 of said block. Blocks 32 and 34 each project both forwardly and rearwardly from carrier bar 30. The rearwardly extending portion constitutes a flat, horizontal gauge plate 48 which is rearwardly widened to a greater width. The forwardly extending portion has formed therein an upwardly opening dove-tail groove 50 which is parallel to bar 30, and in which is slidably engaged the depending dove-tail rib 52 of a slide 54 supported on the associated block 32 or 34. Thus each slide 54 may be moved relative to its supporting block in a direction parallel to bar 30, and its position relative to its block fixed at any desired position by a set screw 56 threaded in said slide. Slide 54 of carriage block 32 has formed integrally therewith a finger 58 which is accurately at right angles to bar 30, and which projects forwardly over base plate 12. Slide 54 of carriage block 34 has formed integrally therewith a finger 60 which is accurately at right angles to bar 30 and parallel to finger 58, and which projects forwardly over base plate 12. Fingers 58 and 60 serve respectively as the previously mentioned spacer guide and pleat guide.

Affixed in the top of each slide 54 is an upwardly projecting pin 62. An elongated adjusting lever 64 overlies the top of each slide 54 and its associated carriage block, having a longitudinal slot 66 formed in its forward end portion, said slot being engaged over pin 62, and extending rearwardly past the rearward edge of the associated gauge plate 48. Closely adjacent slide 54, each lever 64 is pivoted to the associated carriage block 32 or 34 by means of a vertical screw 68. Thus by grasping and pivoting the rearward ends of levers 64, when set screws 56 are loosened, slides 54 may be moved laterally along the carriage blocks. The positions of said slides relative to their carriage blocks may be determined by reading scales 70 imprinted on the tops of gauge plates 48 at their rearward edges, each relative to an edge of the associated lever 64. Since the lever length from pivot 68 to scale 70 is much greater than the lever length from pivot 68 to pin 62, scales 70 may be calibrated in very small increments of an inch, and still be clearly readable.

Intermediate fingers 58 and 60, and parallel thereto, an elongated slot 72 is formed through base plate 12. Said slot is of a width sufficient to accomodate presser foot 6, so that stitching can be performed through said base plate, and is of a length to permit stitching along a line of the maximum length it may be desired to sew. The stitch line is represented by the longitudinal midline of slot 72. At each side of slot 72 is disposed an upright, forwardly facing stop 74 parallel with bar 30. Said stops are coplanar, being integral with a horizonatal U-shaped yoke 76 which is offset rearwardly around the rearward end of slot 72, and which is secured to base plate 12 by screws 78 which engage in slots of the yoke to permit forward and rearward adjustment of stops 74. It will be understood that said stops are so adjusted that as base plate 12 is moved forwardly during stitching, stops 74 will have reached the transverse vertical plane of needle 4 at the time forward movement of plate 12 is arrested by forward stops 18 of rails 14. A pair of leaf-type clamp springs 79 are each secured at their rearward ends to bar 30, as by rivets 80, curve upwardly and forwardly over stops, 74, and press downwardly against plate 12 forwardly of said stops, respectively at opposite sides of slot 72. As shown in FIG. 1, a scale 82, calibrated in inches and reading from the centerline of slot 72, is imprinted on the top surface of base plate 12, to the left of said slot and generally in alignment with stops 74.

In operation, screws 20 are first loosened and rear stops 24 adjusted to permit a total forward and rearward movement of base plate 12 equal to the length of the stitch lines desired, that is, the distance the stitch lines are to extend downwardly from the top edge of the drape. This distance is generally to or just below the level at which the traverse rod hooks will engage the drape, and is most commonly between 3 ½ and 6 inches. Screws 20 are then re-tightened.

Next, pleat guide finger 60 is moved relative to slot 72 so that the edge thereof confronting said slot is spaced from the center line of the slot by a distance accurately equal to one-half of the fabric width to be consumed in each pleat, and space guide finger 58 is adjusted so that the edge thereof confronting slot 72 is spaced from the centerline of the slot by a distance accurately equal to one-half to the fabric width to be consumed in each pleat, plus the fabric width between two successive pleats. These settings must be most be most precise if the face of the drape is to be pleated at each of its vertical edges, leaving the proper amount of return and overlap at the respectively opposite sides, and if the pleats are to be of uniform depth and equally spaced, and if the cumulative effect of small errors in forming each pleat, as pleating progresses from one edge of a drapery panel to the other, is to be avoided. As previously mentioned, the present guide is adapted to be used in conjunction with a carefully prepared set of charts or tables, sold together with the guide device. Said tables, given such information as the return and overlap desired, the original width of the drapery panel and the width to which it is to be reduced by pleating, and the number and depth of pleats desired, will prescribe the required settings of fingers 58 and 60 with a high degree of accuracy. These settings are most accurately made by first loosening set screws 38 and moving carriage blocks 32 and 34 to the number of whole inches in the indicated settings, by matching edges 42 and 46 of said blocks with the whole inch marks of scales 40 and 44 of carrier bar 30, then tightening set screws 38. Scales 40 and 44 are calibrated in inches by which fingers 58 and 60 are spaced from the centerline of slot 72, when adjusting levers 64 are set at the zero points of scales 70. Then set screws 56 are loosened and levers 64 are pivoted to the desired fractional inch settings on scales 70, and set screw 56 re-tightened.

This moves slides 54 on the carriage blocks to position fingers 58 and 60 to the desired spacing from the centerline of slot 72 with a high degree of accuracy, the movement of the carriage blocks amounting to a "coarse" setting, and the movement of slides 54 on the carriage blocks amounting to a "fine" setting. Due to the high ratio of the length of levers 64 rearwardly of their pivots 68 to their lengths forwardly of said pivots, scales 70 are greatly expanded, and they may be calibrated to divisions representing movements of fingers 58 and 60 as small as 1/64 of an inch, or even smaller, while still being easily readable.

The device is then ready for use in actual pleating. As a first step, a panel 84 of drapery fabric is laid over base plate 12, face side down, and engaged under clamp springs 79, with one edge 86 thereof, which will eventually be one of the vertical side edges of the panel, pulled accurately against pleat guide finger 60, as diagrammatically indicated in FIG. 6, and with the edge thereof which will be the top edge of the panel pulled accurately against stops 74. The body of the drape thus extends forwardly and to the left from the operator, who is seated at the rear of machine bed plate 2. The top edge of the drapery fabric is of course first hemmed, and stiffened by a buckram or crinoline insert in the hem, as is common practice, but these operations are not pertinent to the present invention.

Next, the operator manually refolds the top edge portion of the fabric panel on itself, as indicated at 88 in FIG. 7, keeping the fabric taut and placing the fold accurately at the marking of scale 82, imprinted on the base plate, corresponding to the desired width of the return portion of the drape, if edge 86 is the outer edge of a panel, or to the desired width of the "overlap" portion of the panel, if edge 86 will be the inner vertical edge of a panel. Scale 82 is calibrated directly in inches from the centerline of slot 72, so that the panel width between edge 86 and fold 88, as shown in FIG. 7, will then be equal to the desired width of the return (or overlap) plus one-half the fabric width to be used in each pleat.

Next, the operator creases fold 88 with his fingers, presses the fabric layers at both sides of the firmly together, pulls the fabric from beneath clamps 79, reverses the fold so that it extends toward pleat guide finger 60, reinserts both layers of the fabric beneath clamps 79, and pulls fold 88 against finger 60, as shown in FIG. 8, with the top panel edge still against stops 74. Base plate 12 is then pulled as far forwardly as permitted by the preset position of forward stops 24, presser foot 6 is lowered, and the sewing machine actuated so that needle 4 and bobbin mechanism 8 cooperate to stitch a line 90 along the midline of slot 72, from the needle position shown in FIG. 1 to a point aligned with stops 74, at which time movement of base plate 12 is arrested by rear stops 18. During stitching, the fabric is advanced forwardly by feeder mechanism 10. If base plate 12 is freely slidable on machine bed plate 2, the advancing fabric will pull the base plate along with it, since they are joined by clamps 79. Alternatively, base plate 12 could be advanced by a power mechanism, at a speed equal to the stitching speed, driven by the sewing machine system and geared to feeder mechanism 10. Some sewing machines are already equipped with power driven, fabric-supporting base plates of this type. Also, in some machines the stitching action once initiated is automatically continued until any predetermined point, in this case when stops 74 become aligned with needle 4, and then automatically stopped. The first pleat, indicated at 92, is thus completed, and the parts have the positions shown in FIG. 8.

Next, the operator manually folds the fabric along a line parallel to line 88, as shown in FIG. 9, the fold line being indicated at 94, positioning said fold accurately, in this case, at spacer guide finger 58, with the fabric taut. Conveniently, the fold line may be marked accurately by pressing the fabric firmly, with a finger, against the sharp edge of finger 58, to form a visible crease. The fabric width between folds 94 and 88 will then be equal to the full width of fabric used in a single pleat, plus the required spacing between successive pleats.

Next, the operator secures fold 94 with his fingers, removes the fabric from clamps 79, reverses the fold, reinserts the fabric beneath the clamps, and pulls fold 94 accurately against finger 60, keeping the top panel edge against stops 74, in precisely the same manner as fold 88 was previously treated, and a second stitch line 96 made, the parts then having the positions shown in FIG. 10. This completes the second pleat, indicated at 98. The process is repeated, using finger 58 as a folding guide, until the full width of the drapery panel has been pleated. If the pleating is done carefully, with fingers 58 and 60 accurately positioned in accordance with the requirements of the charts and tables, the fabric width left over after formation of the last pleat will be equal to the desired overlap, or return, as the case may be. If the present guide, and the accompanying tables and charts, are used properly, accuracies in the final total width of the panel amounting to variations of less than one-eighth of an inch are readily obtainable. With great care, even greater accuracy is possible.

Customarily, the fold line of each pleat, such as fold line 88 of pleat 92, is tucked inside of the pleat, and tacked as by stitching to stitch line 90. This provides a more attractive "gathered" appearance to each pleat. However, this inversion of the pleats is not pertinent to the present invention.

While I have shown and described a specific embodiment of my invention, it will be readily apparent that many minor changes of structure and operation could be made without departing from the spirit of the invention.

What I claim as new and desire to protect by Letters Patent is:

1. In combination with a sewing machine having a bed plate and being operable to stitch a straight line in fabric supported on and moved over said bed plate, a drapery pleating guide comprising:

a. a base plate supported on and movable over said bed plate, b. guide members limiting movement of said base plate to a line parallel to said stitch line, said base plate overlying said stitch line and being slotted to permit stitching therethrough, and being operable to support a panel of drapery fabric for movement relative to said bed plate, c. a pair of straight guide fingers overlying and carried by said base plate, said fingers being parallel to said stitch line at transversely opposite sides thereof, and d. adjusting means operable to vary the transverse spacing of each of said guide fingers from said stitch line.

2. The structure as recited in claim 1 wherein one of said guide fingers is spaced from said stitch line by a distance equal to one-half the fabric width to be consumed in a single pleat by stitching both layers of said fabric together in spaced apart parallel relation to a fold of said fabric, and the other of said guide fingers is spaced oppositely from said stitch line by a distance equal to said one-half pleat width, plus the spacing between a successive pair of pleats.

3. The structure as recited in claim 1 with the addition of stop members operable to limit movement of said base plate relative to said bed plate to a distance equal to the length of the stitch lines to be used in forming said pleats.

4. The structure as recited in claim 3 wherein said stop members are adjustable, whereby to vary the length of said stitch lines.

5. The structure as recited in claim 1 with the addition of upright stop members carried by said base plate and defining a raised straight guide for an edge of said drapery fabric at right angles to said stitch line.

6. The structure as recited in claim 1 with the addition of clamp members carried by said base plate and operable to secure said drapery fabric releasably against the upper surface of said base plate.

7. The structure as recited in claim 6 wherein said clamp members comprise a pair of leaf springs having portions biased downwardly toward said base plate, respectively at laterally opposite sides of said stitch line.

8. The structure as recited in claim 1 wherein said adjusting means for each of said guide fingers comprises:

a. a carrier bar affixed to said base plate at right angles to said stitch line, b. a carriage block slidable along said carrier bar to a predetermined position as measured by a scale imprinted on said carrier bar, c. a slide mounted on said carriage block for slidable movement parallel to said carrier bar and carrying said guide finger, and d. an adjusting lever pivoted to said carriage block, one end thereof being connected to said slide, and the other end thereof being movable relative to a scale imprinted on said carriage block, whereby movement of said lever moves said slide relative to said carriage block.

9. The structure as recited in claim 8 with the addition of:

a. a first locking means operable to secure said carriage block releasably against movement on said carrier bar, and b. a second locking means operable to secure said slide releasably against movement on said carriage block.

10. The structure as recited in claim 8 wherein the length of said adjusting lever from the pivot thereof to said scale is substantially greater than the length thereof from said pivot to its connection with said slide, whereby relatively large divisions of said scale represent relatively small movements of said slide relative to said carriage block.

* * * * *